US008888533B2

(12) United States Patent
Westman et al.

(10) Patent No.: US 8,888,533 B2
(45) Date of Patent: Nov. 18, 2014

(54) CABLE HEADER CONNECTOR

(75) Inventors: John Eugene Westman, Harrisburg, PA (US); Brian Keith McMaster, Jr., Mechanicsburg, PA (US); Megha Shanbhag, Santa Clara, CA (US); Eric Douglas Springston, II, Hershey, PA (US); Robert Lee Putt, Jr., Enola, PA (US); Jeffrey Alan Schleig, York Haven, PA (US); Julia Anne Lachman, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/585,992

(22) Filed: Aug. 15, 2012

(65) Prior Publication Data

US 2014/0051295 A1 Feb. 20, 2014

(51) Int. Cl.
*H01R 24/00* (2011.01)

(52) U.S. Cl.
USPC ..... 439/626

(58) Field of Classification Search
USPC ..... 439/626, 607.01, 607.45, 532, 676, 92
See application file for complete search history.

(56) References Cited

U.S. PATENT DOCUMENTS

| | | | | |
|---|---|---|---|---|
| 4,889,503 | A | 12/1989 | Philippson et al. | |
| 6,203,369 | B1 | 3/2001 | Feldman | |
| 7,637,767 | B2 | 12/2009 | Davis et al. | |
| 2005/0112920 | A1 | 5/2005 | Venaleck et al. | |
| 2011/0256764 | A1 * | 10/2011 | Wu | 439/607.01 |
| 2013/0078871 | A1 * | 3/2013 | Milbrand, Jr. | 439/676 |
| 2013/0149898 | A1 * | 6/2013 | Schroll et al. | 439/607.01 |

FOREIGN PATENT DOCUMENTS

| | | | |
|---|---|---|---|
| EP | 0670616 | A1 | 9/1995 |
| WO | 2004/062046 | A1 | 7/2004 |
| WO | 2011/094656 | A2 | 8/2011 |

OTHER PUBLICATIONS

International Search Report dated Oct. 22, 2013 received for related PCT Patent Application No. PCT/US2013/053160.

* cited by examiner

*Primary Examiner* — Jean F Duverne

(57) ABSTRACT

A cable header connector includes a cable including a pair of signal wires, a contact sub-assembly terminated to the cable and a ground shield providing electrical shielding for the contact sub-assembly. The contact sub-assembly has a mounting block having contact channels therein. The contact sub-assembly has a pair of signal contacts each received in corresponding contact channels and held in the contact channels by an interference fit. The contact channels receive corresponding signal wires of the cable and position the signal wires in position adjacent to the corresponding signal contacts. The signal contacts are laser welded to the signal wires of the cable at terminating ends of the signal contacts after being positioned in the contact channels.

20 Claims, 6 Drawing Sheets

CABLE HEADER CONNECTOR

CROSS REFERENCE TO RELATED APPLICATIONS

This application relates to U.S. patent applications having U.S. patent application Ser. Nos. 13/314,336; 13/314,380; 13/314,415; and 13/314,458, each filed on Dec. 8, 2011, the subject matter of each of which is herein incorporated by reference in its entirety.

BACKGROUND OF THE INVENTION

The subject matter herein relates generally to cable header connectors.

High speed differential connectors are known and used in electrical systems, such as communication systems to transmit signals within a network. Some electrical systems utilize cable mounted electrical connectors to interconnect the various components of the system.

Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other.

Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, with a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, at the interface between the signal conductors and the cables, signal degradation is problematic due to improper shielding at such interface. Termination of the cable to the signal conductors is a time consuming and complicated process. Additionally, terminating contacts to controlled impedance cables while maintaining such impedance and signal integrity is problematic. In some systems, the cables include drain wires, which are difficult and time consuming to terminate within the connector due to their relatively small size and location in the cable. For example, the drain wires are soldered to a grounded component of the electrical connector, which is time consuming. Furthermore, general wiring practices require that the drain wire either be placed facing upward or placed facing downward at the termination, which adds complexity to the design of the grounded component of the electrical connector and difficulty when soldering the drain wire at assembly. Motion of the cable during handling can add unwanted stresses and strains to the cable terminations resulting in discontinuity or degraded electrical performance. Additionally, consistent positioning of the wires of the cables before termination is difficult with known electrical connectors and improper positioning may lead to degraded electrical performance at the termination zone. When many cables are terminated in a single electrical connector, the grounded components of the cables are not electrically connected together, which leads to degraded electrical performance of the cable assemblies.

A need remains for an electrical connector having improved cable termination and shielding to meet particular performance demands.

BRIEF DESCRIPTION OF THE INVENTION

In one embodiment, a cable header connector is provided including a cable including a pair of signal wires, a contact sub-assembly terminated to the cable and a ground shield providing electrical shielding for the contact sub-assembly. The contact sub-assembly has a mounting block having contact channels therein. The contact sub-assembly has a pair of signal contacts each received in corresponding contact channels and held in the contact channels by an interference fit. The contact channels receive corresponding signal wires of the cable and position the signal wires in position adjacent to the corresponding signal contacts. The signal contacts are laser welded to the signal wires of the cable at terminating ends of the signal contacts after being positioned in the contact channels.

In another embodiment, a cable header connector is provided including a contact module having a support body and a plurality of cable assemblies held by the support body. The support body has a metal holder being generally planar and having a plurality of windows therethrough. The cable assemblies each include a cable including a pair of signal wires, a contact sub-assembly terminated to the cable, and a ground shield providing electrical shielding for the contact sub-assembly. The contact sub-assembly has a mounting block having contact channels therein. The contact sub-assembly has a pair of signal contacts each received in corresponding contact channels and terminated to corresponding signal wires of the cable at terminating ends of the signal contacts. The ground shield has positioning tabs extending therefrom. The ground shield is coupled to the metal holder such that the positioning tabs are received in corresponding windows to position the ground shield relative to the metal holder. The ground shield is electrically and mechanically coupled to the metal holder.

DETAILED DESCRIPTION OF THE INVENTION

Figures 1, 2:
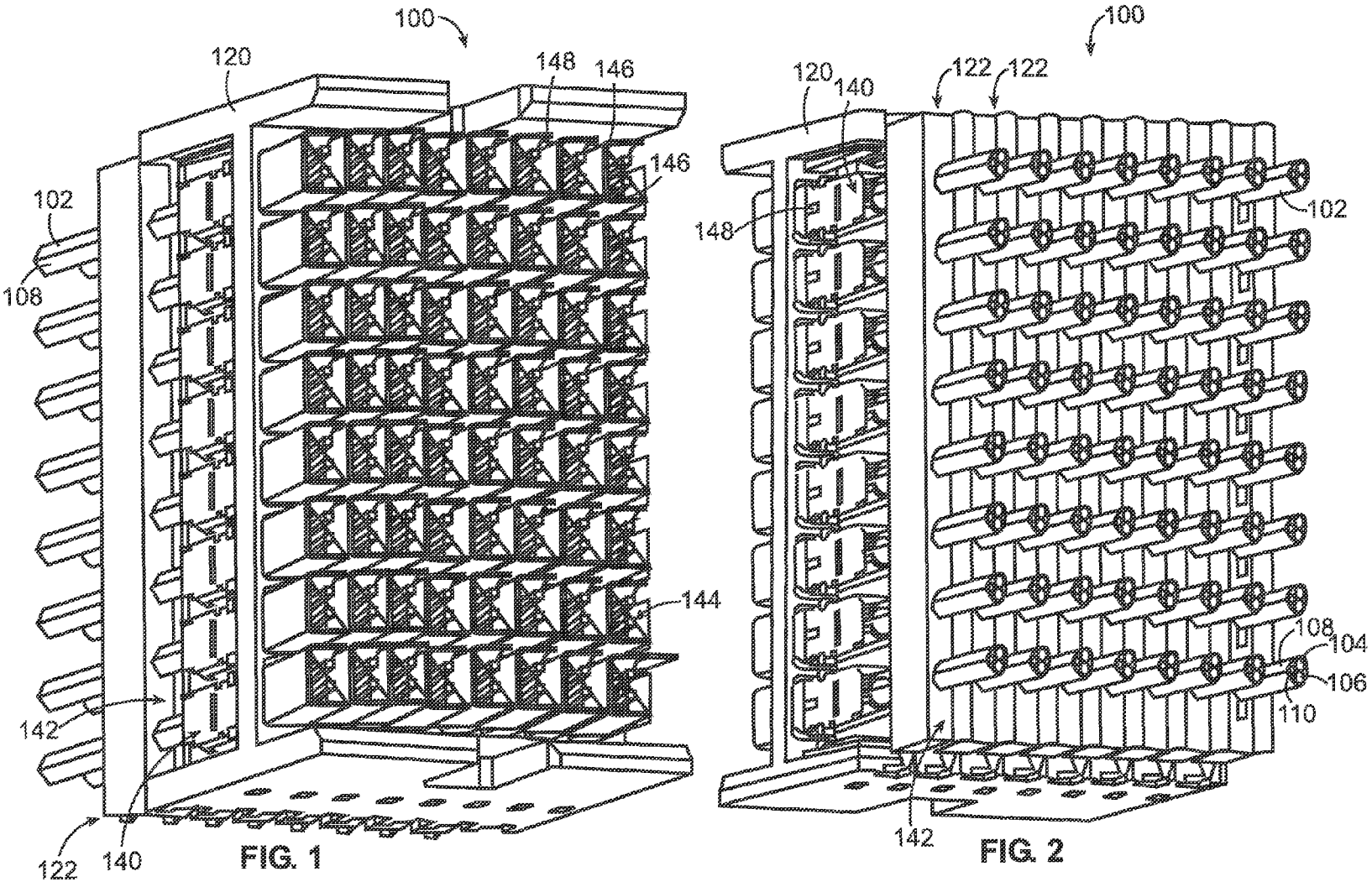
FIG. 1 is a front perspective view of a cable header connector formed in accordance with an exemplary embodiment.
FIG. 2 is a rear perspective of the cable header connector.

FIG. 1 is a front perspective view of a cable header connector 100 formed in accordance with an exemplary embodiment. FIG. 2 is a rear perspective of the cable header connector 100. The cable header connector 100 is configured to be mated with a receptacle connector (not shown). The receptacle connector may be board mounted to a printed circuit board or terminated to one or more cables, for example. The cable header connector 100 is a high speed differential pair cable connector that includes a plurality of differential pairs of conductors mated at a common mating interface. The differential conductors are shielded along the signal paths thereof to reduce noise, crosstalk and other interference along the signal paths of the differential pairs. The cable shielding and arrangement of conductors may control impedance of the cable header connector 100.

A plurality of cables 102 extend rearward of the cable header connector 100. In an exemplary embodiment, the cables 102 have two signal wires 104, 106 within a common jacket 108 of the cable 102. The signal wires 104, 106 convey differential signals. In an exemplary embodiment, the pair of signal wires 104, 106 is shielded, such as with a cable braid. The cable braids define grounded elements of the cable 102. A drain wire 110 is also provided within the jacket 108 of the cable 102. The drain wire 110 is electrically connected to the shielding of the signal wires 104, 106. The drain wire 110 defines a grounded element of the cable 102. The grounded elements of the cable 102 provide shielding for the signal wires 104, 106 into the cable header connector 100. Other types of cables 102 may be provided in alternative embodiments. For example, coaxial cables each carrying a single signal conductor may extend from the cable header connector 100.

The cable header connector 100 includes a header housing 120 holding a plurality of contact modules 122. Multiple contact modules 122 are loaded into the header housing 120. The header housing 120 holds the contact modules 122 in parallel such that the cable assemblies 140 are aligned in a column. Any number of contact modules 122 may be held by the header housing 120 depending on the particular application.

Each of the contact modules 122 includes a plurality of cable assemblies 140 held by a support body 142. Each cable assembly 140 includes a contact sub-assembly 144 configured to be terminated to a corresponding cable 102. The contact sub-assembly 144 includes a pair of signal contacts 146 terminated to corresponding signals wires 104, 106. The cable assembly 140 also includes a ground shield 148 providing shielding for the signal contacts 146. In an exemplary embodiment, the ground shield 148 peripherally surrounds the signal contacts 146 along the entire length of the signal contacts 146 to ensure that the signal paths are electrically shielded from interference. The ground shield 148 is configured to be electrically coupled to one or more grounded components, such as the drain wire 110, of the corresponding cable 102. The ground shield 148 is configured to be electrically coupled to the support body 142 for additional shielding and grounding. The ground shield 148 is configured to be electrically coupled to corresponding grounded components of the receptacle assembly when mated thereto.

The support body 142 provides support for the contact sub-assembly 144 and ground shield 148. In an exemplary embodiment, the cables 102 extend along the support body 142 with the support body 142 supporting a length or portion of the cables 102. The support body 142 may provide strain relief for the cables 102.

Figure 3:
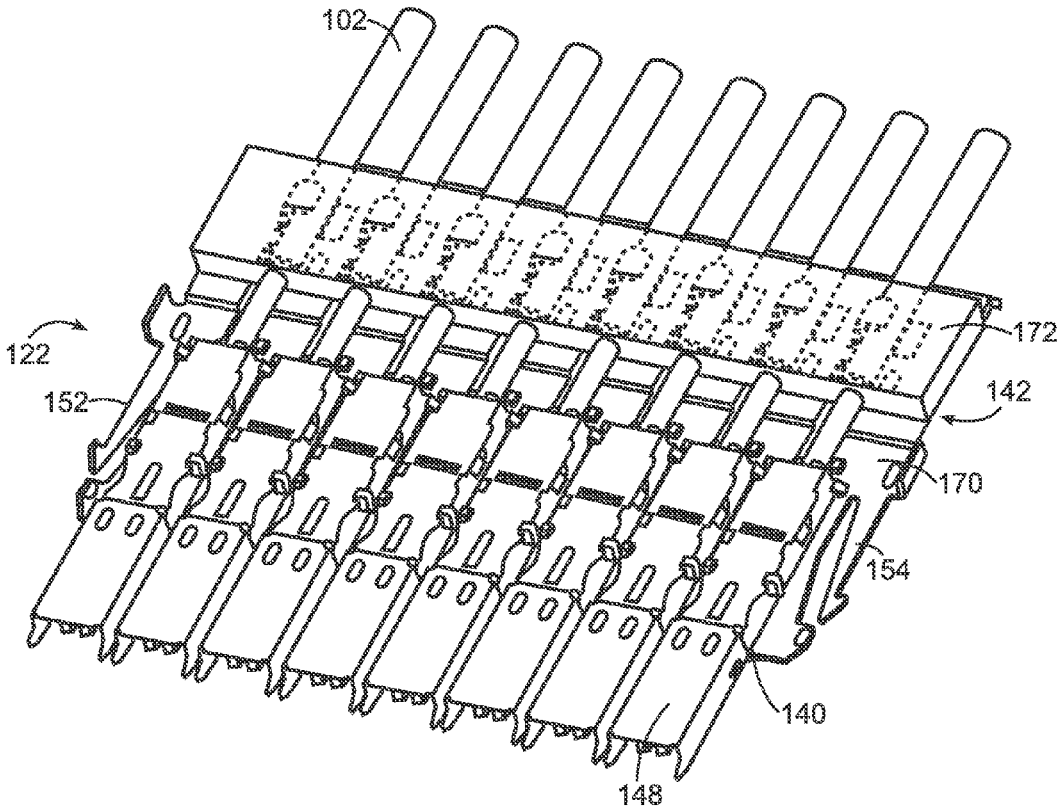
FIG. 3 is a front perspective view of a contact module for the cable header connector.

FIG. 3 is a front perspective view of one of the contact modules 122. In an exemplary embodiment, the contact module 122 includes latches 152, 154 that engage corresponding latch elements (e.g. openings) on the header housing 120 (shown in FIGS. 1 and 2) to secure the contact module 122 in the header housing 120. The latches 152, 154 may be integrally formed with the support body 142. Other types of latching features may be used in alternative embodiments to secure the contact module 122 to the header housing 120.

In the illustrated embodiment, the contact module 122 includes a metal holder 170 and a cover 172 coupled to the metal holder 170. The metal holder 170 and cover 172 define the support body 142. The metal holder 170 supports the cable assemblies 140 and/or the cables 102. The cover 172 is attached to the metal holder 170 and supports and/or provides strain relief for the cables 102. In an exemplary embodiment, the cover 172 is a plastic cover. The cover 172 may be overmolded over the cables 102. The cover 172 may be attached to the cables 102 and/or the metal holder 170 by other means or processes in alternative embodiments. For example, the cover 172 may be pre-molded and attached to the side of the metal holder 170 over the cables 102. The cover 172 may be a hot melt material applied over the cables 102 to secure the cables 102 to the metal holder 170. The cover 172 engages the cables 102 to provide strain relief for the cables 102.

The cable assemblies 140 are mounted to the metal holder 170. The ground shields 148 are coupled directly to the metal holder 170. For example, the ground shields 148 may include tabs, press-fit pins or other features such as latches, clips, fasteners, solder, and the like, that engage the metal holder 170 to attach the ground shields 148 to the metal holder 170. The ground shields 148 are attached to the metal holder 170 such that the ground shields 148 are mechanically and electrically coupled to the metal holder 170. The metal holder 170 electrically commons each of the ground shields 148.

Optionally, a ground ferrule 180 (shown in FIG. 4) may be coupled to an end of the cable 102. The ground ferrule 180 may be electrically connected to one or more grounded elements of the cable 102, such as the drain wire 110 (shown in FIG. 2). The ground shield 148 and/or the metal holder 170 may be electrically connected to the ground ferrule 180 to create a ground path or grounded connection to the cable 102.

Figure 4:
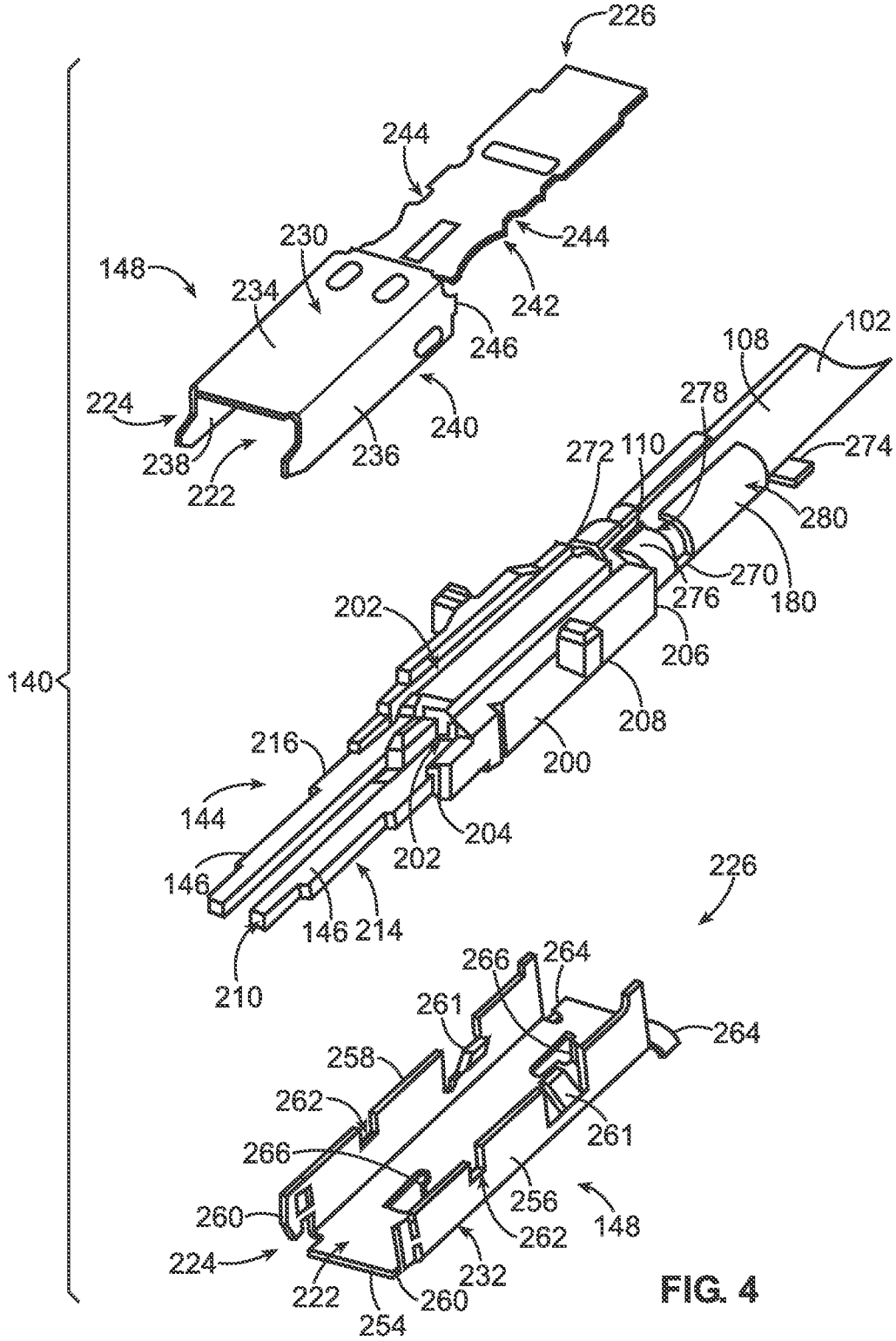
FIG. 4 is an exploded view of a cable assembly of the contact module.

FIG. 4 is an exploded view of one of the cable assemblies 140 illustrating the ground shield 148 poised for coupling to the contact sub-assembly 144. The contact sub-assembly 144 includes a mounting block 200 that holds the signal contacts 146 and signal wires 104, 106 (shown in FIG. 2). The mounting block 200 includes contact channels 202 that receive corresponding signal contacts 146 therein. The contact channels 202 are generally open at a top of the mounting block 200 to receive the signal contacts 146 therein, but may have other configurations in alternative embodiments. The mounting block 200 includes features to secure the signal contacts 146 in the contact channels 202. For example, the signal contacts 146 may be held by an interference fit in the contact channels 202. The mounting block 200 and contact channels 202 are designed for impedance control of the signal contacts 146, with design consideration given to the shape of the signal contacts 146, the spacing of the signal contacts 146 and the dielectric characteristics of the material and/or air gaps between the signal contacts 146 and/or the ground shield 148.

The mounting block 200 is positioned forward of the cable 102. The signal wires 104, 106 extend into the mounting block 200 for termination to the signal contacts 146. The mounting block 200 is shaped to guide or position the signal wires 104, 106 therein for termination to the signal contacts 146. In an exemplary embodiment, the signal wires 104, 106 are terminated to the signal contacts 146 in-situ after being loaded into the mounting block 200. In an exemplary embodiment, the mounting block 200 positions the signal contacts 146 and signal wires 104, 106 in direct physical engagement for laser welding. The signal wires 104, 106 and signal contacts 146 are precisely held by the mounting block 200 for automated or manual laser welding.

The mounting block 200 extends between a front 204 and a rear 206. In an exemplary embodiment, the signal contacts 146 extend forward from the mounting block 200 beyond the front 204. The mounting block 200 includes locating posts 208 extending from opposite sides of the mounting block 200. The locating posts 208 are configured to position the mounting block 200 with respect to the ground shield 148 when the ground shield 148 is coupled to the mounting block 200.

Figure 6:
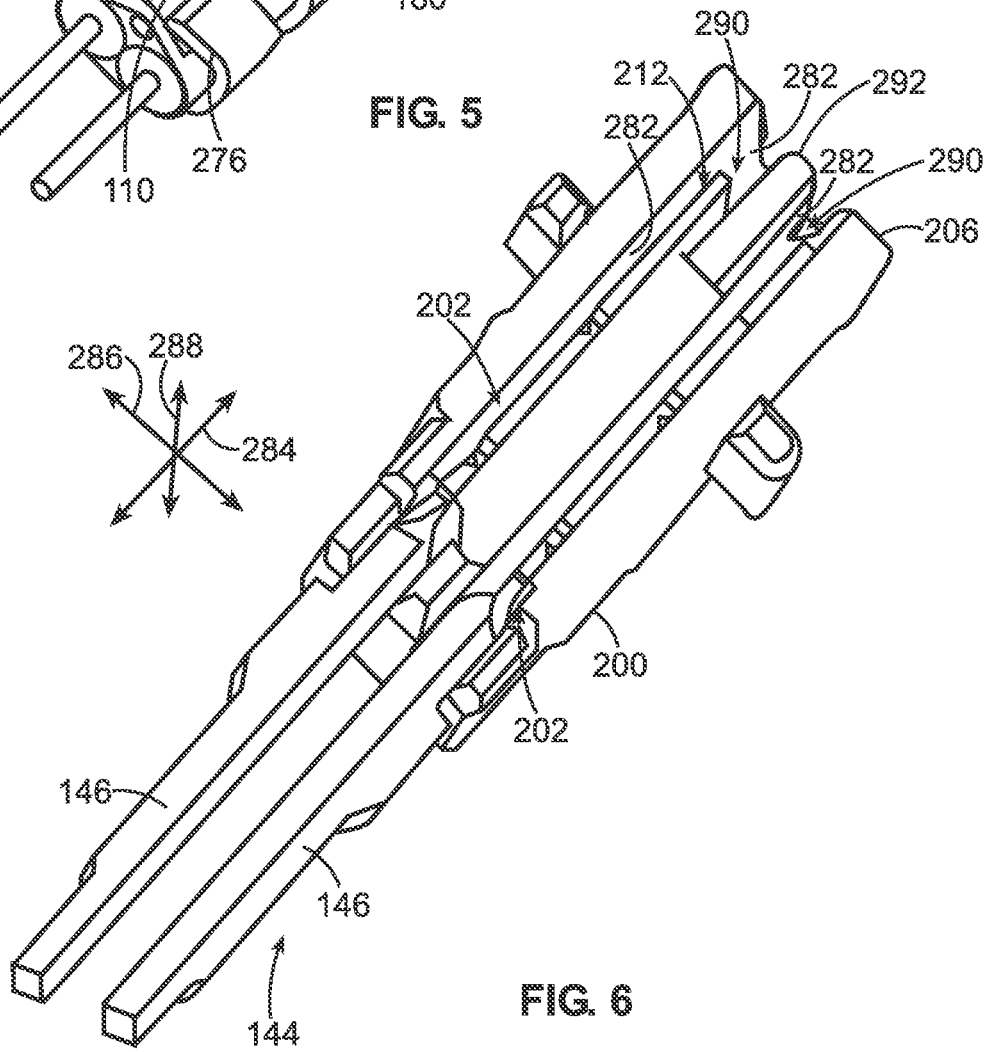
FIG. 6 is a top perspective view of a contact sub-assembly of the cable assembly.

The signal contacts 146 extend between mating ends 210 and terminating ends 212 (shown in FIG. 6). The signal contacts 146 are terminated to corresponding signal wires 104, 106 of the cable 102 at the terminating ends 212. For example, the terminating ends 212 may be laser welded to exposed portions of the conductors of the signal wires 104, 106. Alternatively, the terminating ends 212 may be terminated by other means or processes, such as by soldering the terminating ends 212 to the signal wires 104, 106, by crimping the terminating ends 212 to the signal wires 104, 106, by using insulation displacement contacts, or by other means. The signal contacts 146 may be stamped and formed or may be manufactured by other processes.

In an exemplary embodiment, the signal contacts 146 have pins 214 at the mating ends 210. The pins 214 extend forward from the front 204 of the mounting block 200. The pins 214 are configured to be mated with corresponding receptacle contacts (not shown) of the receptacle connector (not shown). Optionally, the pins 214 may include a wide section 216 proximate to the mounting block 200. The wide section 216 is configured to be received in the header housing 120 (shown in FIGS. 1 and 2) and held therein by an interference fit. The narrower portions of the pins 214 forward of the wide section 216 may more easily be loaded into the header housing 120.

The ground shield 148 has a plurality of walls that define a chamber 222 that receives the contact sub-assembly 144. The ground shield 148 extends between a mating end 224 and a terminating end 226. The mating end 224 is configured to be mated with the receptacle connector. The terminating end 226 is configured to be electrically connected to the ground ferrule 180 and/or the cable 102. The mating end 224 of the ground shield 148 is positioned either at or beyond the mating ends 210 of the signal contacts 146 when the cable assembly 140 is assembled. The terminating end 226 of the ground shield 148 is positioned either at or beyond the terminating ends 212 of the signal contacts 146. The ground shield 148 provides shielding along the entire length of the signal contacts 146. In an exemplary embodiment, the ground shield 148 provides shielding beyond the signal contacts 146, such as rearward of the terminating ends 212 and/or forward of the mating ends 210. The ground shield 148, when coupled to the contact sub-assembly 144, peripherally surrounds the pair of signal contacts 146. Because the ground shield 148 extends rearward beyond the terminating ends 212 of the signal contacts 146, the termination between the signal contacts 146 and the signal wires 104, 106 is peripherally surrounded by the ground shield 148. In an exemplary embodiment, the ground shield 148 extends along at least a portion of the cable 102 to ensure that all sections of the signal wires 104, 106 are shielded.

The ground shield 148 includes an upper shield 230 and a lower shield 232. The chamber 222 is defined between the upper and lower shields 230, 232. The contact sub-assembly 144 is positioned between the upper shield 230 and the lower shield 232.

In an exemplary embodiment, the upper shield 230 includes an upper wall 234 and side walls 236, 238 extending from the upper wall 234. The upper shield 230 includes a shroud 240 at the mating end 224 and a tail 242 extending rearward from the shroud 240 to the terminating end 226. The tail 242 is defined by the upper wall 234. The shroud 240 is defined by the upper wall 234 and the side walls 236, 238. In an exemplary embodiment, the shroud 240 is C-shaped and has an open side along the bottom thereof. The shroud 240 is configured to peripherally surround the pins 214 of the signal contacts 146 on three sides thereof. The upper shield 230 may have different walls, components and shapes in alternative embodiments.

The tail 242 includes locating features 244 that are used to locate the upper shield 230 with respect to the mounting block 200 and/or the lower shield 232. In the illustrated embodiment, the locating features 244 are cut-outs that receive the locating posts 208 to locate the upper shield 230 with respect to the mounting block 200.

The upper shield 230 includes grounding features 246 used to connect the upper shield 230 to the lower shield 232. The grounding features 246 may be used to both mechanically and electrically connect the upper and lower shields 230, 232. In the illustrated embodiment, the grounding features 246 are tabs that are configured to be laser welded to the lower shield 232. Other types of grounding features 246 may be used in alternative embodiments. For example, press-fit pins, latches, fasteners, clips and the like may be used to mechanically and/or electrically connect the upper shield 230 to the lower shield 232. Optionally, the tail 242 of the upper shield 230 may be connected to the ferrule 180. For example, the upper shield 230 may be laser welded to the ferrule 180.

In an exemplary embodiment, the lower shield 232 includes a lower wall 254 and side walls 256, 258 extending upward from the lower wall 254. The lower shield 232 includes grounding features 260, 261 extending from the side walls 256, 258. The grounding features 260 are configured to engage the upper shield 230, such as the grounding features 246 of the upper shield 230 or other portions of the upper shield 230, to connect the lower shield 232 to the upper shield 230. In the illustrated embodiment, the grounding features 261 are compliant tabs that are configured to be biased against the ferrule 180 to ensure direct physical contact therewith. The grounding features 260 and/or 261 may be laser welded in-situ to mechanically and electrically connect the lower shield 232 to the upper shield 230 and/or the ferrule 180. Other types of grounding features may be used in alternative embodiments to connect the lower shield 232 to the upper shield 230 and/or the ferrule 180. For example, the lower shield 232 may be laser welded to the ferrule 180.

The lower shield 232 includes openings 262 in the side walls 256, 258. The openings 262 are configured to receive the locating posts 208 when the contact sub-assembly 144 is loaded into the ground shield 148. Other types of locating features may be used in alternative embodiments to position the contact sub-assembly 144 with respect to the ground shield 148 and/or to hold the axial position of the contact sub-assembly 144 with respect to the ground shield 148.

The lower shield 232 includes longitudinal positioning tabs 264 and lateral positioning tabs 266 extending from the lower wall 254. The positioning tabs 264, 266 extend out of plane with respect to the lower wall 254. The longitudinal positioning tabs 264 are angled outward in opposite directions. The longitudinal positioning tabs 264 are configured to engage the metal holder 170 (shown in FIG. 3) to longitudinally position the cable assembly 140 with respect to the metal holder 170. The lateral positioning tabs 266 are approximately centrally located between the side walls 256, 258. The lateral positioning tabs 266 may be located at other positions in alternative embodiments. The lateral positioning tabs 266 are configured to engage the metal holder 170 to laterally position the cable assembly 140 with respect to the metal holder 170. Optionally, the positioning tabs 264 and/or 266 may be used to lock the lower shield 232 to the metal holder 170.

The ground ferrule 180 includes a ferrule body 270 configured to engage and be electrically connected to a grounded element of the cable 102. For example, the ferrule body 270 may engage and be electrically connected to the drain wire 110 (shown in FIG. 2). The ferrule 180 is configured to engage and be electrically connected to the lower shield 232 and/or the upper shield 230. For example, the ferrule body 270 may be laser welded to the lower shield 232 and/or the upper shield 230 after the cable assembly 140 is assembled.

The ferrule body 270 extends between a front 272 and a rear 274. The front 272 is positioned immediately rearward of the mounting block 200. Optionally, the front 272 may abut against the mounting block 200. In an exemplary embodiment, the ferrule 180 includes tabs 276 at the front 272. The tabs 276 are configured to engage a grounded component of the cable 102, such as the drain wire 110. The tabs 276 directly engage the drain wire 110 for direct electrical connection thereto. Optionally, the tabs 276 may be laser welded to the drain wire 110. In an exemplary embodiment, the cable 102 includes a window 278 through the jacket 108 that exposes the drain wire 110. The tabs 276 extend into or through the window 278 to engage the drain wire 110. The tabs 276 may be laser welded to the drain wire 110 in-situ after the ferrule 180 is secured to the cable 102.

In an exemplary embodiment, the ferrule 180 includes a crimp barrel 280 at the rear 274. The crimp barrel 280 is configured to be crimped to the cable 102. The ferrule 180 provides strain relief for the cable 102.

Figure 5:
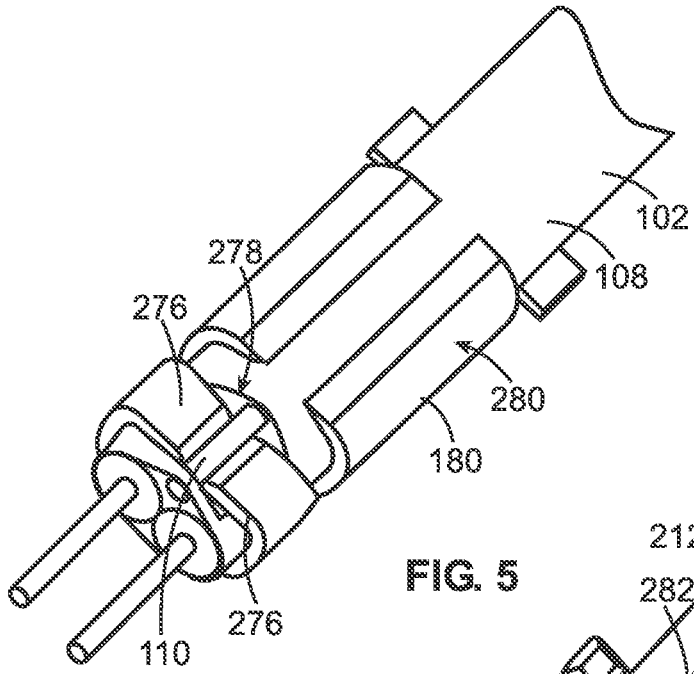
FIG. 5 is a top perspective view of a ferrule of the cable assembly.

FIG. 5 is a top perspective view of the ferrule 180 secured to the end of the cable 102. The crimp barrel 280 is crimped to the cable 102 to position the ferrule 180 with respect to the cable 102. The ferrule 180 provides strain relief for the cable 102. FIG. 5 illustrates the tabs 276 in the window 278 engaging the drain wire 110. The tabs 276 are configured to be laser welded to the drain wire 110 to electrically connect the ferrule 180 to the grounded component(s) of the cable 102. The window 278 may be entirely surrounded by the jacket 108. For example, the jacket 108 may extend forward of the window 278, such as to hold the drain wire 110 in position for terminating the tabs 276 to the drain wire 110.

Figure 7:
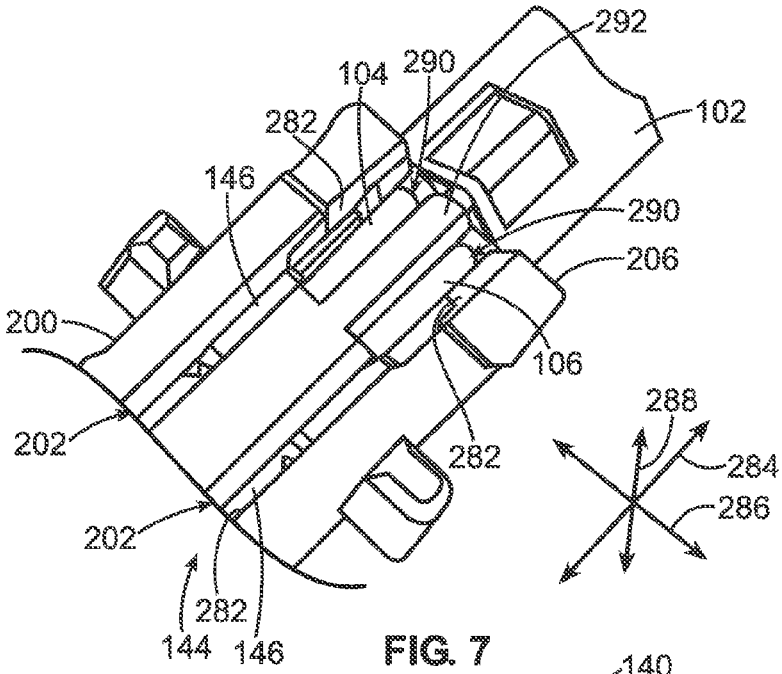
FIG. 7 illustrates a cable coupled to signal contacts of the contact sub-assembly.

FIG. 6 is a top perspective view of the contact sub-assembly 144 showing the signal contacts 146 held in the mounting block 200. FIG. 7 illustrates the cable 102 coupled to the signal contacts 146 and the mounting block 200. As shown in FIG. 6, the signal contacts 146 are loaded into the contact channels 202 and are rigidly positioned therein. For example, the signal contacts 146 may be held in the contact channels 202 by an interference fit. In an exemplary embodiment, locating walls 282 defining the contact channels 202 are sized and shaped to position the signal contacts 146 along a longitudinal axis 284, a lateral axis 286 and a transverse axis 288. Having the position of the signal contacts 146 tightly controlled ensures that the signal contacts 146 are properly positioned for terminating to the signal wires 104, 106 (shown in FIGS. 1 and 2).

Wire receiving spaces 290 are defined at the rear 206 of the mounting block 200. The locating walls 282 at least partially define the wire receiving spaces 290. In an exemplary embodiment, a center locating wall 292 is positioned between the two wire receiving spaces 290. The signal contacts 146 are exposed in the wire receiving spaces 290. The locating walls 282 guide the signal wires 104, 106 into the wire receiving spaces 290. As shown in FIG. 7, the center locating wall 292 presses the signal wires 104, 106 into engagement with the signal contacts 146. The signal contacts 146 are terminated to the signal wires 104, 106 in-situ. For example, the signal contacts 146 may be laser welded to the signal wires 104, 106.

Figure 8:
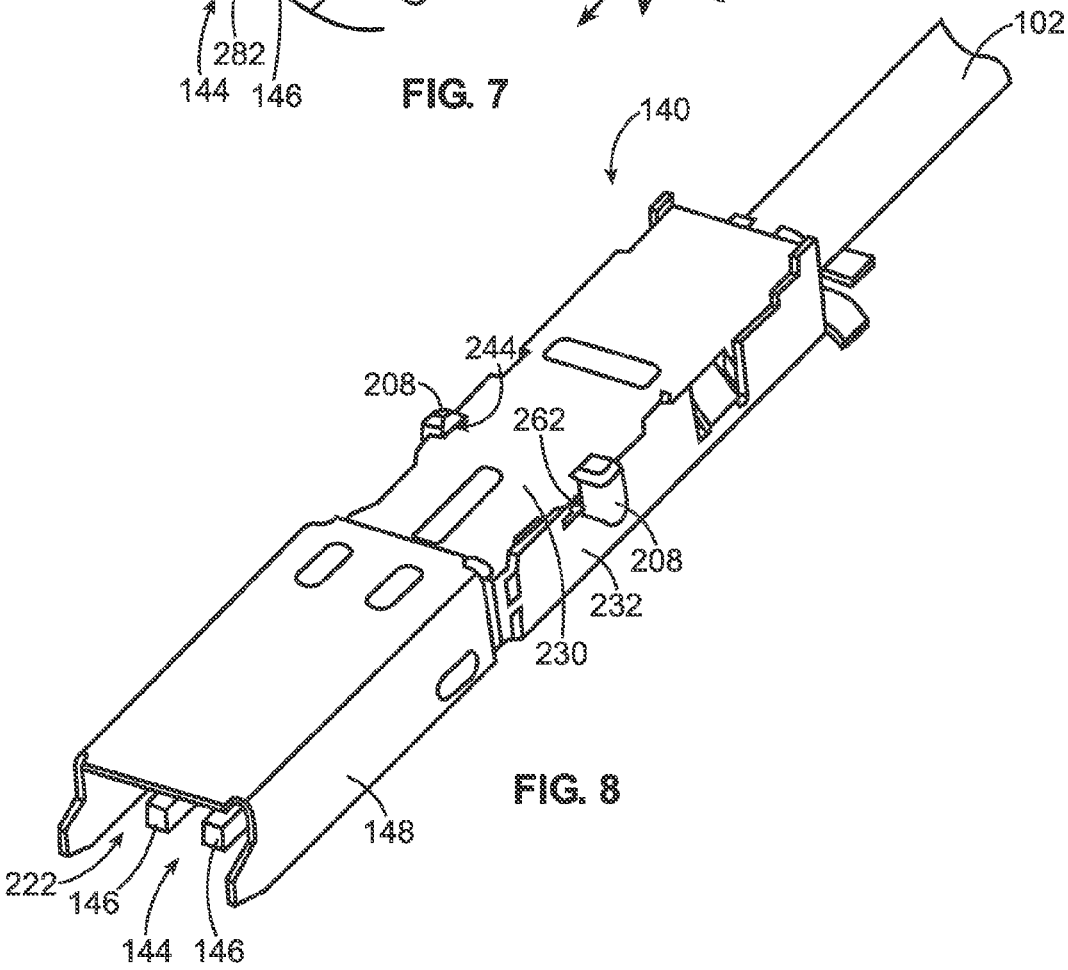
FIG. 8 illustrates the cable assembly in an assembled state.

FIG. 8 illustrates the cable assembly 140 in an assembled state. The contact sub-assembly 144 is loaded into the ground shield 148. The ground shield 148 is electrically coupled to the ferrule 180 (shown in FIG. 5). The lower shield 232 is mechanically and electrically coupled to the upper shield 230, such as by laser welding the lower shield 232 to the upper shield 230.

When assembled, the locating posts 208 are received in the openings 262 in the lower shield 232 and/or the locating features 244 of the upper shield 230 to secure the axial position of the contact sub-assembly 144 with respect to the ground shield 148. The ground ferrule 180 and a portion of the cable 102 are also received in the chamber 222. The ground shield 148 provides peripheral shielding around the ground ferrule 180 and the cable 102. The ground shield 148 provides electrical shielding for the signal contacts 146.

Figure 9:
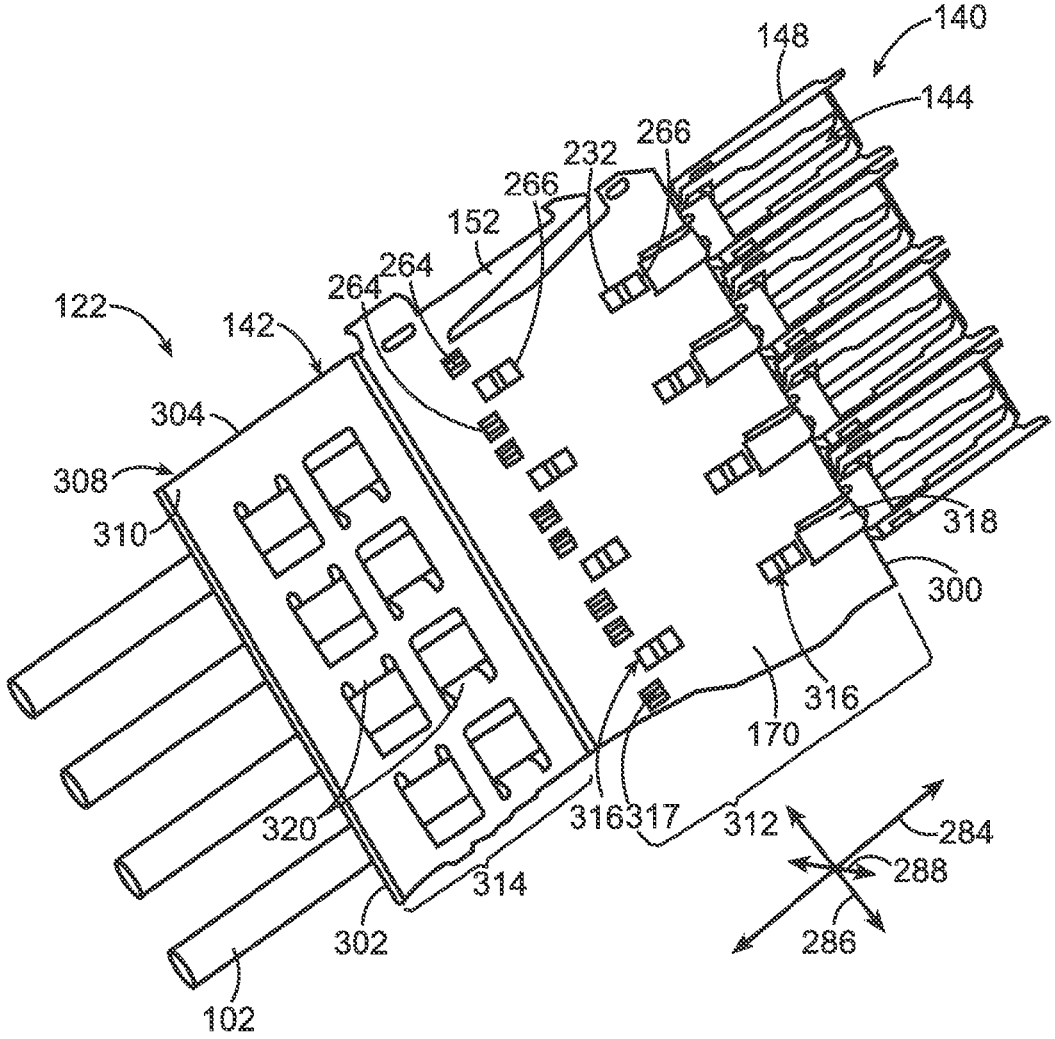
FIG. 9 is a bottom perspective view of a portion of a contact module.

FIG. 9 is a bottom perspective view of a portion of one of the contact modules 122. A plurality of the cable assemblies 140 are shown coupled to the support body 142. The metal holder 170 extends between a front 300 and a rear 302. The metal holder 170 has a first side 308 and a second side 310. Optionally, the metal holder 170 may be generally planar. The front 300 of the metal holder 170 is configured to be loaded into the header housing 120 (shown in FIG. 1) during assembly. The latches 152 extend from a top 304 and are used to secure the metal holder 170 in the header housing 120. The cable assemblies 140 and the cables 102 are attached to the first side 308 of the metal holder 170. The cover 172 (shown in FIG. 3) is configured to be attached to the first side 308.

The metal holder 170 includes a contact plate 312 proximate to the front 300 and a cable plate 314 proximate to the rear 302. The cable plate 314 may extend from the contact plate 312. The contact plate 312 is configured to engage and support the contact sub-assemblies 144 and/or the ground shields 148. For example, the lower wall 254 (shown in FIG. 4) of the lower shield 232 is configured to abut directly against the first side 308 of the contact plate 312. The cable plate 314 is configured to engage and support the cables 102.

The contact plate 312 includes a plurality of windows 316, 317 therethrough positioned to receive the lateral positioning tabs 266 and longitudinal positioning tabs 264, respectively. In an exemplary embodiment, the lateral positioning tabs 266 are initially aligned with the corresponding windows 316 and loaded therethrough. The cable assembly 140 is then slid or shifted forward, such as in a longitudinal direction along the longitudinal axis 284. The lateral positioning tabs 266 engage the metal holder 170 and capture the metal holder 170 between the lateral positioning tabs 266 and the lower wall 254. The lateral positioning tabs 266 resist pullout of the cable assemblies 140 from the metal holder 170, such as in a direction along the transverse axis 288. The lateral positioning tabs 266 engage the sides of the windows 316 to resist movement, such as shifting, of the cable assemblies 140 in a lateral direction along the metal holder 170, such as in a direction along the lateral axis 286. The cable assembly 140 is slid or shifted forward until the longitudinal positioning tabs 264 are aligned with the corresponding windows 317. Once aligned, the longitudinal positioning tabs 264 spring into the windows 317. The longitudinal positioning tabs 264 resist movement, such as shifting, of the cable assemblies 140 in a longitudinal direction along the metal holder 170, such as in a direction along the longitudinal axis 284. The positioning tabs 264, 266 resist movement of the cable assemblies 140 longitudinally, laterally and transversely.

In an exemplary embodiment, the contact plate 312 includes a plurality of spring fingers 318 extending therefrom. The spring fingers 318 are deflectable beams that are angled out of the plane of the contact plate 312. The spring fingers 318 are provided proximate to the front 300. The spring fingers 318 are configured to engage a ground shield 148 of another contact module 122 when assembled in the header housing 120. The spring fingers 318 electrically common the metal holder 170 with the ground shield 148 of another contact module 122. Alternatively, the spring fingers 318 may engage another grounded component of the other contact module, such as the metal holder 170 of the other contact module 122 or another ground beam of the other metal holder 170, for example.

The cable plate 314 extends from the contact plate 312. The cable plate 314 extends along the cables 102 and may provide electrical shielding along the cables 102. Optionally, features of the cable plate 314 may engage and be electrically connected to one or more grounded elements of the cable 102.

In an exemplary embodiment, the cable plate 314 includes cable strain relief fingers 320 extending therefrom. The cable strain relief fingers 320 are configured to engage the cables 102 to hold the cables 102 with respect to the metal holder 170. The cable strain relief fingers 320 may be bent or crimped around the cables 102 after the cables 102 are loaded onto the cable plate 314. Optionally, two cable strain relief fingers 320 engage each cable 102, where the cable strain relief fingers 320 extend in different directions and hold opposite sides of the cable 102. Other types of features may be used in alternative embodiments to hold the cables 102. In an exemplary embodiment, when the cover 172 (shown in FIG. 3) is attached to the metal holder 170, such as by being overmolded over the cables 102, the cover 172 engages the cable strain relief fingers 320 to secure the cover 172 to the metal holder 170.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable header connector comprising:

a cable including a pair of signal wires;

a contact sub-assembly terminated to the cable, the contact sub-assembly having a mounting block having contact channels therein, the contact sub-assembly having a pair of signal contacts each received in corresponding contact channels and held in the contact channels by an interference fit, the signal contacts having terminating ends, the contact channels receiving corresponding signal wires of the cable and positioning the signal wires in position adjacent to the terminating ends of the corresponding signal contacts, the signal contacts being laser welded to the signal wires of the cable at the terminating ends of the signal contacts after being positioned in the contact channels; and a ground shield providing electrical shielding for the contact sub-assembly, the ground shield extending along the pair of signal contacts to provide peripheral shielding for the pair of signal contacts along a length of the signal contacts, the ground shield is box-shaped along the mounting block to entirely surround all sides of the mounting block, the ground shield entirely peripherally surrounding the terminating ends and the portions of the signal wires terminated to the terminating ends in the mounting block.

2. The cable header connector of claim 1, wherein the signal wires and signal contacts are exposed in the contact channels of the mounting block for laser welding in-situ.

3. The cable header connector of claim 1, wherein the contact channels comprise locating walls for positioning the signal wires and signal contacts for laser welding in-situ.

4. The cable header connector of claim 1, wherein the ground shield comprises a lower shield and an upper shield coupled together and entirely peripherally surrounding the mounting block and signal contacts along a length thereof, the contact sub assembly being held between the lower and upper shields, the lower and upper shields being laser welded together in-situ after the contact sub assembly is positioned within the ground shield.

5. The cable header connector of claim 1, further comprising a ferrule coupled to the cable and positioned rearward of the mounting block, the ferrule being crimped to the cable to provide strain relief.

6. The cable header connector of claim 1, further comprising a ferrule coupled to the cable and positioned rearward of the mounting block, the ferrule being conductive, the ferrule being electrically coupled to a drain wire of the cable, the ferrule being received in the ground shield such that the ground shield entirely peripherally surrounds the ferrule, the ferrule defining a conductive path between the ground wire and the ground shield.

7. The cable header connector of claim 6, wherein the ferrule is laser welded to the drain wire.

8. The cable header connector of claim 6, wherein the cable comprises a window through a jacket of the cable, the window exposing the drain wire, the ferrule including a tab extending into the window, the tab engaging the drain wire in the window.

9. The cable header connector of claim 1, wherein the cable, the contact sub assembly, and the ground shield comprise a cable assembly, the cable header connector further comprising a support body holding a plurality of cable assemblies, the ground shields of the cable assemblies being electrically coupled to the support body.

10. The cable header connector of claim 9, wherein the ground shields comprise positioning tabs extending therefrom, the positioning tabs extending through the support body to position the ground shields with respect to the support body.

11. The cable header connector of claim 9, wherein the support body and the plurality of cable assemblies comprise a contact module, the cable header connector comprising a plurality of contact modules, the support bodies include spring fingers extending therefrom, the spring fingers engaging at least one ground shield of an adjacent contact module.

12. The cable header connector of claim 1, wherein the signal contacts extend forward of the mounting block, wherein the ground shield is C-shaped forward of the mounting block to peripherally surround a top and two opposite sides of the pair of signal contacts forward of the mounting block.

13. A cable header connector comprising:

a contact module having a support body and a plurality of cable assemblies held by the support body, the support body having a metal holder being generally planar and having a plurality of windows therethrough;

the cable assemblies each comprising a cable including a pair of signal wires, a contact sub-assembly terminated to the cable, and a ground shield providing electrical shielding for the contact sub-assembly, the contact sub-assembly having a mounting block having contact channels therein, the contact sub-assembly having a pair of signal contacts each received in corresponding contact channels and terminated to corresponding signal wires of the cable at terminating ends of the signal contacts;

the ground shield having positioning tabs extending therefrom, wherein each of the ground shields are coupled to the metal holder such that the cable assembles are arranged side by side in a stacked configuration, the positioning tabs of each of the ground shields are received in corresponding windows to position the ground shields relative to the metal holder, the ground shields being electrically and mechanically coupled to the metal holder.

14. The cable header connector of claim 13, wherein further comprising a plurality of contact modules, the support bodies include spring fingers extending therefrom, the spring fingers engaging at least one ground shield of an adjacent contact module.

15. The cable header connector of claim 13, wherein the contact channels comprise locating walls for positioning the signal wires and signal contacts for laser welding in-situ.

16. The cable header connector of claim 13, wherein the ground shield comprises a lower shield and an upper shield coupled together and entirely peripherally surrounding the mounting block and signal contacts along a length thereof, the contact sub assembly being held between the lower and upper shields, the lower and upper shields being laser welded together in-situ after the contact sub assembly is positioned within the ground shield.

17. The cable header connector of claim 13, further comprising a ferrule coupled to the cable and positioned rearward of the mounting block, the ferrule being conductive, the ferrule being laser welded to a drain wire of the cable, the ferrule being received in the ground shield such that the ground shield entirely peripherally surrounds the ferrule, the ferrule defining a conductive path between the ground wire and the ground shield.

18. The cable header connector of claim 13, wherein the positioning tabs define hooks extending through the windows to engage the opposite side of the metal holder to lock the cable assemblies to the metal holder.

19. The cable header connector of claim 13, wherein the positioning tabs comprise longitudinal positioning tabs to longitudinally position the cable assembly relative to the metal holder and lateral positioning tabs to laterally position the cable assembly relative to the metal holder.

20. The cable header connector of claim 13, wherein the ground shield extends along at least two sides of the pair of signal contacts to provide peripheral shielding for the pair of signal contacts along a length of the signal contacts.

* * * * *